United States Patent [19]

Fender

[11] Patent Number: 4,867,031

[45] Date of Patent: Sep. 19, 1989

[54] SADDLE ASSEMBLY FOR GUITAR VIBRATO UNIT

[76] Inventor: C. Leo Fender, 1510 Dana Pl., Fullerton, Calif. 92631

[21] Appl. No.: 193,915

[22] Filed: May 13, 1988

[51] Int. Cl.[4] ..... G10D 3/04

[52] U.S. Cl. ..... 84/313; 84/298

[58] Field of Search ..... 84/298, 299, 307, 313

[56] References Cited

U.S. PATENT DOCUMENTS

| | | | |
|---|---|---|---|
| 4,031,799 | 6/1977 | Fender | 84/307 |
| 4,281,576 | 8/1981 | Fender | 84/298 |
| 4,361,068 | 11/1982 | Schaller | 84/299 |
| 4,385,543 | 5/1983 | Shaw et al. | 84/298 |
| 4,541,320 | 9/1985 | Sciuto | 84/298 |
| 4,549,460 | 10/1985 | Gressett et al. | 84/298 |
| 4,604,936 | 8/1986 | Page et al. | 84/313 |
| 4,681,010 | 7/1987 | Wilkinson | 84/298 |

*Primary Examiner*—Lawrence R. Franklin

*Attorney, Agent, or Firm*—Spensley Horn Jubas & Lubitz

[57] ABSTRACT

An improved saddle assembly for a guitar having a vibrato bridge assembly is disclosed. The improved saddle assembly has two parallel legs joined by a shoulder portion, one of the legs being longer than the other and the shoulder portion being provided with opposing string support grooves. The radius of curvature of the support grooves is larger than the radius of the largest guitar string, and the sides of the support groove are flared. The saddle assembly is reversible for positioning on the guitar so that the longer saddle assembly leg is closer to the centerline of the guitar neck, thereby providing a centering action and sustaining the guitar string upon flatting.

4 Claims, 2 Drawing Sheets

SADDLE ASSEMBLY FOR GUITAR VIBRATO UNIT

BACKGROUND OF THE INVENTION

1. Field of the Invention

This invention relates to a vibrato unit for electric guitars and, more particularly, to an improved saddle assembly for vibrato units.

2. Description of the Related Art

An electric guitar with vibrato includes a body, a neck, and a head, with strings extending from tuning posts on the head to a vibrato bridge assembly on the body. Tuning of the strings is accomplished by using tuning knobs coupled to the tuning posts on the head. The vibrato bridge assembly includes a bridge plate, which is pivotally supported with respect to the body, and a vibrato handle attached to the bridge plate. By pivoting the bridge plate by means of the vibrato handle, the tension on the strings is altered to vary the pitch of the strings so as to achieve vibrato effects.

On the outwardly facing surface of the bridge plate, a plurality of saddle assemblies are provided, one saddle assembly for each guitar string. Each saddle assembly has a shoulder portion over which a guitar string passes, and a leg extending from the shoulder portion in a direction away from the guitar head. A support groove on the outwardly facing surface, or shoulder, of each saddle assembly guides the guitar string over the shoulder. The guitar string is attached at its upper end to the tuning posts at the head and at its lower end is attached to an anchor within the guitar body.

Each saddle assembly is slidably mounted such that it may slide on the bridge plate up toward and down away from the guitar head. A spring loaded adjustment screw typically is connected to the lower end of each saddle assembly leg. Turning the adjustment screw accomplishes the movement up toward and down away from the guitar head to adjust intonation on the strings. Height adjustment screws typically support the upper end of the saddle assemblies. One end of the guitar string is attached to the tuning posts on the guitar neck and the other end terminates in a string end ball attached to the bridge plate assembly in the body of the guitar.

Because of the varying tension on the strings caused by "flatting" the strings with use of the vibrato, the strings may slip out of their proper position in the support groove of the saddle assembly. The guitar string may then come to rest on the shoulder of the saddle assembly after flatting. This results in the strings being out of tune. The guitar string must then be urged carefully back into its proper position in the support groove and then the string must usually be retuned by turning the adjustment screws or by using the tuning knobs. This is disadvantageous because, during the course of playing the guitar, the strings should remain in their proper positions with respect to the head, neck, and vibrato bridge assembly. It is therefore desirable to provide an improved saddle assembly that reduces the tendency of the strings to slip out of their proper position within the support groove after vibrato.

SUMMARY OF THE INVENTION

The present invention is directed to an improved saddle assembly provided with a first extended leg, supported by an adjustment screw, and a second short leg parallel to the first leg. The first and second legs are joined at one end by the curved shoulder portion of the saddle assembly. Opposing support grooves are located on both the outwardly facing and reverse surfaces of the curved shoulder. The support groove has flared sides and a radius of curvature such that the guitar string tends to center itself in the groove after the string is "flatted."

The additional short leg and the curvature of the shoulder and support groove cooperate to prevent the string from falling out of its proper position on the saddle assembly when the vibrato is used to "flat" the strings. Guitar play can thereby proceed uninterrupted through repeated use of the vibrato unit, without repositioning and retuning the guitar strings. The support groove of the present invention and flared sides allow the string to sustain longer than otherwise and also prevent the strings from pinching on the sides of the groove after vibrato.

The force of the guitar string over the support groove of the present saddle assembly tends to pull the saddle assembly laterally in the direction from the short leg toward the extended leg. Providing a support groove on both surfaces of the saddle assembly allows either side of the saddle assembly to be used as a support surface for the string. The force of the strings on the saddle assemblies can then be used to provide a self-centering action for the saddle assemblies. By orienting the saddle assemblies so that the extended leg of each saddle assembly is placed closest to the center of the bridge assembly, the saddle assemblies will tend to move toward each other. The self-centering action serves to push the saddle assemblies together, maintain proper spacing, avoid vibration of the bridge unit, and better sustain the string during flatting.

BRIEF DESCRIPTION OF THE DRAWINGS

The invention will now be described with reference to the accompanying drawings, wherein.

DETAILED DESCRIPTION OF THE DRAWINGS

The following description is of the best presently contemplated mode of carrying out the invention. This description is made for the purpose of illustrating the general principles of the invention and is not to be taken in a limiting sense. The scope of the invention is best determined by reference to the appended claims.

Figure 1:
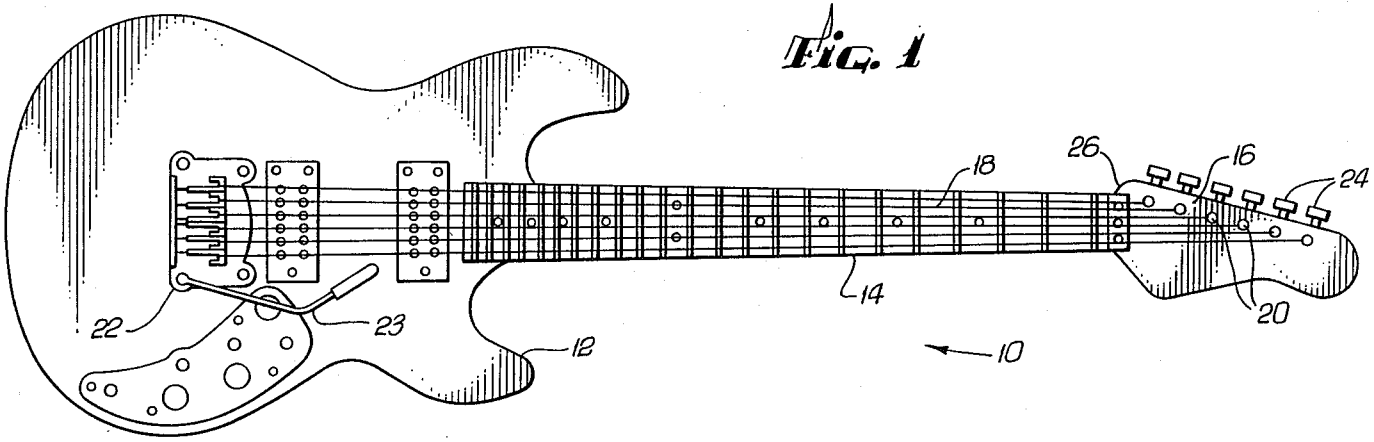
FIG. 1 is a top plan view of an electric guitar incorporating the saddle assemblies of the present invention.

FIG. 1 shows an electric guitar 10, having a body 12, a neck 14, and a head 16. Strings 18 extend from string posts 20 on the head 16 to a vibrato bridge assembly 22 pivotally supported on the body 12. A vibrato arm 23 is attached to the bridge assembly 22 and is employed to pivot the bridge assembly so as to alter the tension on the strings and provide vibrato effects. Tuning of the strings is accomplished by means of tuning knobs 24 coupled to the string posts 20. A string lock assembly 26 may be provided at the lower portion of the head near the neck 14. The string lock assembly 26 is a clamp which is engaged after the strings have been tuned by means of the tuning knobs 24. The string lock assembly is provided so that the operation of the vibrato mechanism will not alter the settings of the tuning knobs, which would cause the guitar to go out of tune.

Figure 2:
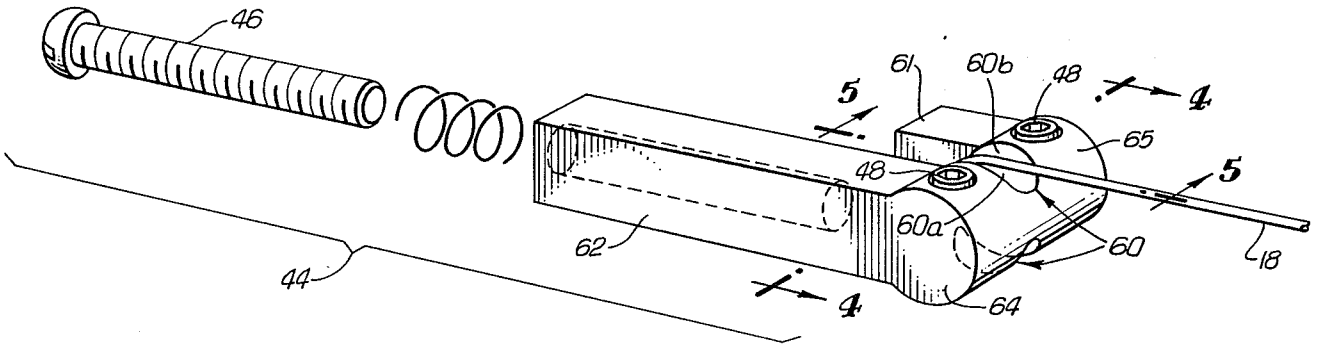
FIG. 2 is a perspective view of a saddle assembly of the present invention.
Figure 4:
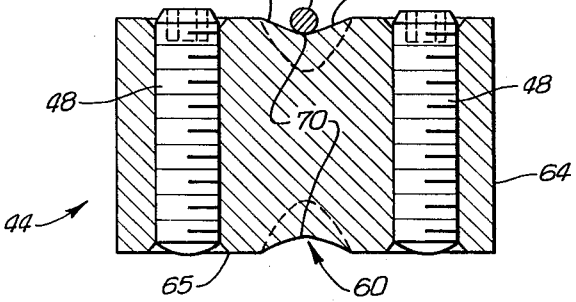
FIG. 4 is a sectional view of a saddle assembly of the present invention taken along line 4—4 in FIG. 2.
Figure 5:
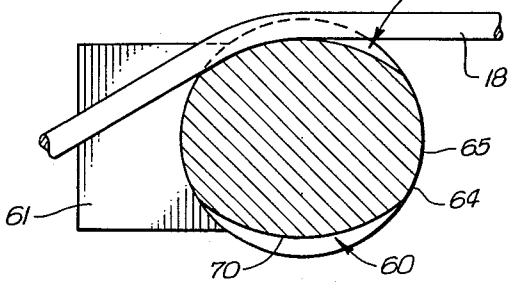
FIG. 5 is a sectional view of a saddle assembly of the present invention taken along line 5—5 in FIG. 2.

FIG. 2 shows a perspective view of a saddle assembly of the present invention, while FIG. 4 shows a sectional view taken along line 4—4 in FIG. 2 and FIG. 5 shows a sectional view taken along line 5—5. The saddle assembly 44 has a shoulder 64 at the top end nearest the guitar head. Projecting from the shoulder, in a direction parallel to the guitar strings, are two parallel legs 61 and 62. The shoulder 64 has a curved surface 65 extending from one surface of the legs 61 and 62 around to the opposing surface of the legs. The curved surface is provided with sloping indentations, forming side surfaces **60*a* and 60*b* of a support groove 60. The present invention provides opposing support grooves on opposing surfaces of the saddle assembly. Thus, the saddle assembly may be inverted and still properly function. A guitar string 18 passes down from the guitar head over the support groove 60, in between the legs 61 and 62, and is attached to an anchor in the guitar body. An extended leg 62 projects farther from the shoulder than the other short leg 61**. The short leg prevents the string from falling out of the support groove when the string is flatted.

The support groove is slightly flared, having side surfaces **60*a* and 60*b* that slope downward in a convex curve to meet at a groove bottom 70. The guitar string 18** seats itself in this support groove bottom. The radius of curvature of the support groove bottom is greater than the radius of the largest guitar string. The curvature and flared sides of the support groove cooperate so that the guitar string tends to center itself in the support groove bottom after the string has been flatted. The string does not pinch on the sides of the groove or come to rest on the sides, above the groove bottom, or on the shoulder of the saddle assembly top surface after the string has been flatted. That is, the largest diameter guitar string can rest completely in the bottom of the support groove of the present invention.

Figure 3:
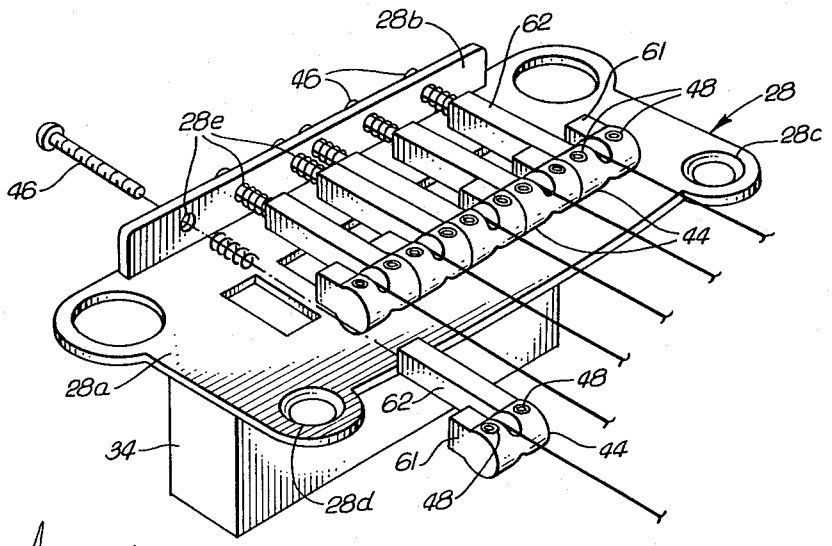
FIG. 3 is a perspective view of the bridge plate assembly of the present invention.

A bridge plate assembly 27 is illustrated in FIG. 3. The assembly includes a bridge plate 28, which is typically formed of chrome plated steel. A counterweight 34 is attached to the bottom of the bridge plate and extends into a hole in the guitar body. The bridge plate 28 includes a main flat portion **28*a* and a lip 28*b* extending upwardly from the rear of the main portion. A plurality of holes 28*e* are formed in the lip 28*b* through which pass adjustment screws 46 for the legs of the saddle assemblies. A pair of holes 28*c* and 28*d*** are formed toward the front edge of the bridge plate, through which support screws pass, allowing the bridge plate to pivot during vibrato.

A plurality of the saddle assemblies 44 are slidably mounted on the top of the bridge plate 28. A spring loaded adjustment screw 46 extends through each hole **28*e* in the bridge plate lip into the extended leg of each saddle assembly and supports the bottom of each saddle assembly. By turning the screw 46, each saddle assembly 44 may be moved toward or away from the head of the guitar so as to adjust the tension on the strings. Two height adjustment screws 48 support the top of each saddle assembly. Rotating the height adjustment screws varies the height of the saddle assembly above the bridge plate 28**.

Providing the saddle assembly with an extended leg results in an added benefit. The force of each guitar string acting on the saddle assembly tends to pull the saddle assembly laterally toward the extended leg 62. By providing opposing support grooves on the top and bottom sides of the saddle assembly, it is possible to put this pulling force to use in creating a self-centering action among the saddle assemblies. If the saddle assemblies are arranged so that the extended leg 62 is placed closest to the centerline of the guitar neck, as illustrated in FIG. 3, the force of the strings will tend to pull the saddle assemblies toward each other. This will push the saddle assemblies together, maintaining proper spacing, and will help better sustain the string.

What is claimed is:

1. In a saddle assembly for a guitar having a body, a neck, a head, guitar strings connected to the head and extending down the neck, and a vibrato bridge assembly to which the strings are secured, the saddle assembly having a shoulder portion with opposing outwardly facing and reverse facing surfaces, and being carried on the bridge plate and movable toward and away from the guitar neck, the improvement comprising:

a saddle assembly having a support groove on the outwardly facing and reverse facing surfaces, and two parallel legs extending from the saddle assembly shoulder portion, one saddle assembly leg being shorter than the other leg, such that a guitar string may pass over the top or bottom surface of the shoulder portion and between the saddle assembly legs.

2. A saddle assembly for a guitar having a body, a neck, a head, and guitar strings extending down the neck, the guitar also having a vibrato bridge assembly including a bridge plate having an outer surface and a plurality of saddle assemblies, each saddle assembly having an outwardly facing surface, an opposing surface, and a shoulder portion and being slidably mounted to the bridge plate, the saddle assembly comprising:

a first leg and a second leg, the legs being parallel and joined at one end to the shoulder portion of the saddle assembly, wherein one of the saddle assembly legs is longer than the other and wherein the shoulder portion between the saddle assembly legs is provided with sloping indentations on the saddle assembly outwardly facing surface and on the opposing surface, forming a pair of opposing support grooves having curved side surfaces that meet in a support groove bottom, the support grooves guiding the guitar string over the saddle assembly shoulder portion and between the first and second leg.

3. The saddle assembly of claim 2 wherein the radius of curvature of each support groove bottom is greater than the diameter of the largest guitar string of the guitar.

4. The saddle assembly of claim 2 wherein the curved side surfaces of the support grooves have a convex curvature.

* * * * *